US006418743B1

(12) United States Patent
Hauser et al.

(10) Patent No.: US 6,418,743 B1
(45) Date of Patent: Jul. 16, 2002

(54) CONDENSING HEAT EXCHANGER

(75) Inventors: Gerhard Hauser, Friedrichshafen; Ludwig Eicher, Salem; Joachim Lucas, Grossschoenach, all of (DE); Johannes Witt, Voorhout (NL); Tanguy Morel, Paris (FR)

(73) Assignees: Astrium GmbH, Friedrichshafen (DE); S.E.C.A.N., Genneviliers (FR)

( * ) Notice: Subject to any disclaimer, the term of this patent is extended or adjusted under 35 U.S.C. 154(b) by 0 days.

(21) Appl. No.: 09/900,446

(22) Filed: Jul. 9, 2001

(30) Foreign Application Priority Data

Jul. 7, 2000 (EP) ..... 00114618

(51) Int. Cl.[7] ..... F25D 21/14
(52) U.S. Cl. ..... 62/281; 62/285; 62/290
(58) Field of Search ..... 62/281, 285, 288, 62/290; 165/110, 111

(56) References Cited

U.S. PATENT DOCUMENTS 2,218,407 A * 10/1940 Meyerhoefer ..... 62/139
3,868,830 A 3/1975 Fletcher et al.
5,250,091 A * 10/1993 Nigsch et al. ..... 55/269
5,305,827 A * 4/1994 Steele et al. ..... 165/133
6,102,994 A * 8/2000 Zhou et al. ..... 106/15.05

FOREIGN PATENT DOCUMENTS

| | | |
|---|---|---|
| DE | 19748295 | 5/1999 |
| EP | 0859210 | 8/1998 |
| FR | 2565339 | 12/1985 |

* cited by examiner

*Primary Examiner*—Denise L. Esquivel
*Assistant Examiner*—Melvin Jones
(74) *Attorney, Agent, or Firm*—Crowell & Moring LLP

(57) ABSTRACT

The invention relates to a condensing heat exchanger comprising a condenser section containing a plurality of internal fins, on which water is condensed and a succeeding slurper section, in which the condensate is removed. The condenser section and the slurper section are connected by a capillary bridge comprising capillary spaces wherein the condensate formed on the fins is transported by means of capillary forces inside the slurper section.

10 Claims, 3 Drawing Sheets

CONDENSING HEAT EXCHANGER

BACKGROUND OF THE INVENTION

This application claims the priority of European application 00114618.2, filed Jul. 7, 2001, the disclosure of which is expressly incorporated by reference herein.

The invention relates to condensing heat exchangers, and more particularly to condensing heat exchangers employing both a condenser section and a slurper section.

A condensing heat exchanger is a main component of air conditioning systems. It simultaneously cools and de-humidifies the air to be conditioned. During this process water condenses on the surface of the air side surface (air fins) of the condensing heat exchanger. The condensed water on the air fins has to be separated from the air stream. On earth this is generally done by the gravity forces. For space applications under the absence of gravity the condensed water is sucked off by applying underpressure.

A prior art design principle (FIG. 1) already proven in several applications, e.g. in spacelab missions, is to add a so called slurper section 3 to the condenser section 1 of the condensing heat exchanger 16 from which the condensed water together with some air is sucked off through the slurpor holes 7 by applying underpressure. However, this design requires that the air flow velocity is high enough to push the condensed water out from the air fins against the capillary forces which tend to hold the water inside the air fins. In case of low air flow velocities and when the distance between neighbouring fins 2 is small a significant amount of water can accumulate inside the air fins and is released spontaneously. This could result in a poor water separation performance of the slurper section.

The object of the present invention is to provide a condensing heat exchanger in which trapping of the condensate inside the condensing section can be decreased and a high water separation can be obtained.

In accordance with the invention the condensing heat exchanger comprises a capillary bridge, which connects the condensing section and the slurper section of the condensing heat exchanger. The capillary bridge comprises capillary spaces wherein the condensate formed on the fins of the condenser section is transported inside the slurper section by means of capillary forces.

In a preferred embodiment the capillary space is defined by an interstitial space which is formed by at least one plate arranged in proximity to a section of the internal surface of the slurper section. The water is pulled from the condensing section into the interstitial spaces between the plates and the surface of the slurper section by capillary forces and transported inside the slurper section. By applying, for example, reduced pressure the water together with an air stream penetrates through dedicated slurper holes through which it exits the slurper section.

The plates can be attached to the surface of the slurper section by means of clamps or bolts. An advantage arising from the use of clamps or bolts for attaching the plates to the slurper section is that the capillary bridge is capable of being added to an existing hardware or being removed after assembly of the condensing heat exchanger.

In another embodiment of the invention the capillary bridge is formed by a capillary fleece or mesh. The water is pulled by capillary forces from the air fins into the cavities of the fleece or mesh and then exits by applying e.g. reduced pressure together with an air stream through dedicated slurper holes.

In the case of the capillary bridge comprising plates, the distance between the plates and the internal surface of the slurper section, which affects the capillary force, is adjusted by dedicated spacers. When using a fleece or a mesh as capillary bridge the fleece or mesh is directly applied on the internal surface of the slurper section without spacers. The plate, fleece or mesh can be attached by mechanical treatments e.g. solding or welding.

In a further embodiment of the invention the surface of the condensing section is coated. Preferably a hydrophilic coating is used. Thus, the transport of the water condensed on the air fins toward the capillary bridge is supported. Other surface treatments, e.g. mechanical, thermal or chemical treatments, which result into a hydrophilic characteristic of the surface are possible.

The condensing heat exchanger according to the invention can be used under microgravity conditions or under 1 and higher gravity conditions. In the case of using the condensing heat exchanger under micro-gravity conditions, e.g. space applications, the water is extracted from the air stream in the slurper section through applied underpressure. In this application the condensing heat exchanger can be used in any spatial orientation.

When the condensate should be removed solely by gravity, for example, on earth, the condensing heat exchanger should be oriented in such a manner that the plates forming the capillary bridge are oriented parallel to the gravity force. The water sucked into the capillary bridge by capillary forces is pulled down to the bottom of the capillary bridge by gravity. At the bottom of the capillary bridge a water column is formed. If the height of the water column in the capillary bridge produces a hydrostatic pressure which is greater than the capillary pressure of the capillary bridge the water can leave the capillary bridge. In order not to block the water suction from the fins at the bottom of the condenser section the slurper section including the capillary bridge has to be extended below the bottom of the condensing heat exchanger. So it is guaranteed that the water can leave the slurper section by gravity forces without applying underpressure.

The present invention is dedicated mainly to space application for use in manned spacecrafts. However, it can also be applied on earth to improve water separation performance of a condensing heat exchanger.

Other objects, advantages and novel features of the present invention will become apparent from the following detailed description of the invention when considered in conjunction with the accompanying drawings.

BRIEF DESCRIPTION OF THE DRAWINGS

The invention is described in more detail with reference to the accompanying drawings, in which.

DETAILED DESCRIPTION OF THE PREFERRED EMBODIMENT

Figure 1:
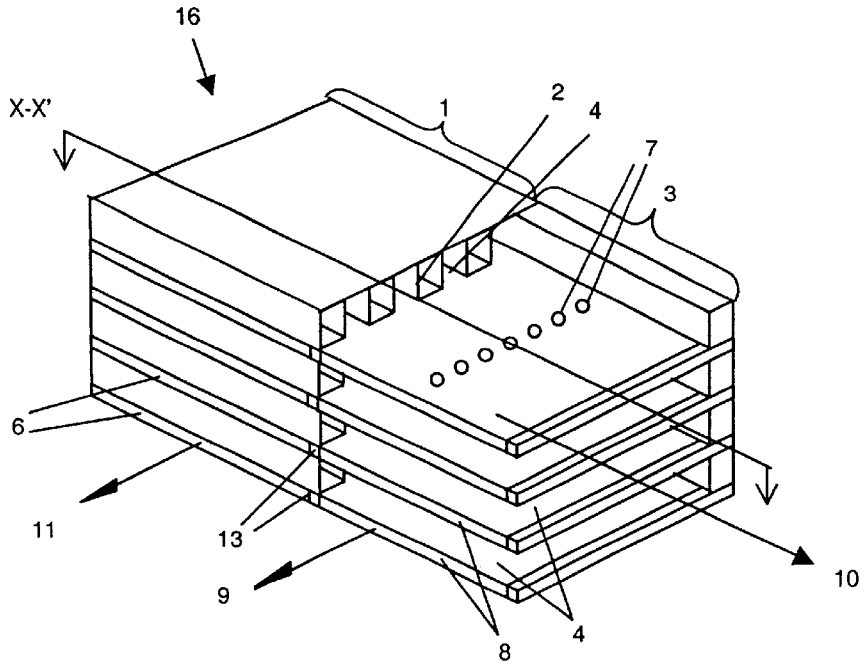
FIG. 1 is a schematical illustration of a condensing heat exchanger according to the prior art.

FIG. 1 shows a 3D schematic illustration of a condensing heat exchanger 16 according to the prior art comprising a condenser section 1 and a succeeding slurper section 3. The condensing section 1 comprises a stack of alternating air flow channels 4 and water channels 6. In order to enlarge the internal surface of the condenser section 1 air fins 2 are arranged inside the air flow channels 4. Inside the condenser section 1 the air passes the air fins 2 in parallel direction, whereas the coolant water 11 flows in the water channels 6 perpendicular to the air flow 10. The slurper section 3 is adjacent to the condenser section 1 and comprises slurper channels 8 being an extension of the water channels 6 of the condenser section 1 but being separated from the water channel 6 by spacer bars 13. In the slurper channel 8 slurper holes 7 are provided through which water from the air flow 10 can penetrate into the slurper channel 8 by applying an underpressure. The slurper flow 9 in the slurper channel 8 containing separated water and air is oriented parallel to the coolant water flow 11 in the condenser section 1.

Figure 2:
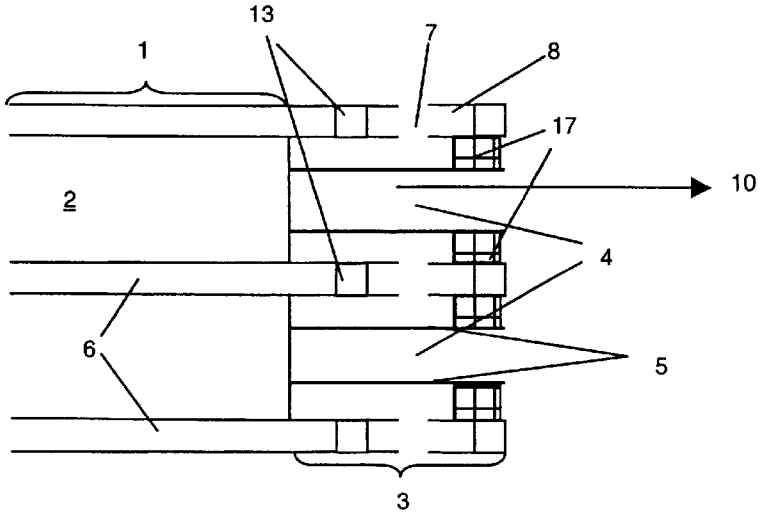
FIG. 2 is a cross sectional side view along the line X–X' of the condensing heat exchanger of FIG. 1 with the additional capillary bridge according to a first embodiment of the invention.

FIG. 2 shows a first embodiment of the capillary bridge according to the invention. A plate 5 is arranged on either side of the air flow channel 4 to form a capillary bridge. The plates 5 are mounted in close proximity to the internal surface of the air flow channel 4 in the slurper section 3. In the embodiment shown in FIG. 2 the plates 5 are arranged parallel to the internal surface of the air flow channel 4. Further, the plates 5 are in direct contact with the ends of the air fins 2 of the condenser section 1. The distance between the plates 5 and the surface of the slurper section 3 is adjusted by dedicated spacers 17. These spacers 17 are e.g. integrated on the plates 5. Over a slurper hole 7 the capillary bridge (i.e. the interstitial space between plate 5 and the surface of the air flow channel 4) is connected to a slurper channel 8 so that condensed water can be removed. The slurper holes 7 are preferably evenly spaced over the flow width inside the slurper section 3 (see FIG. 1) such that a homogeneous flow in the slurper section 3 can be achieved.

Figure 3:
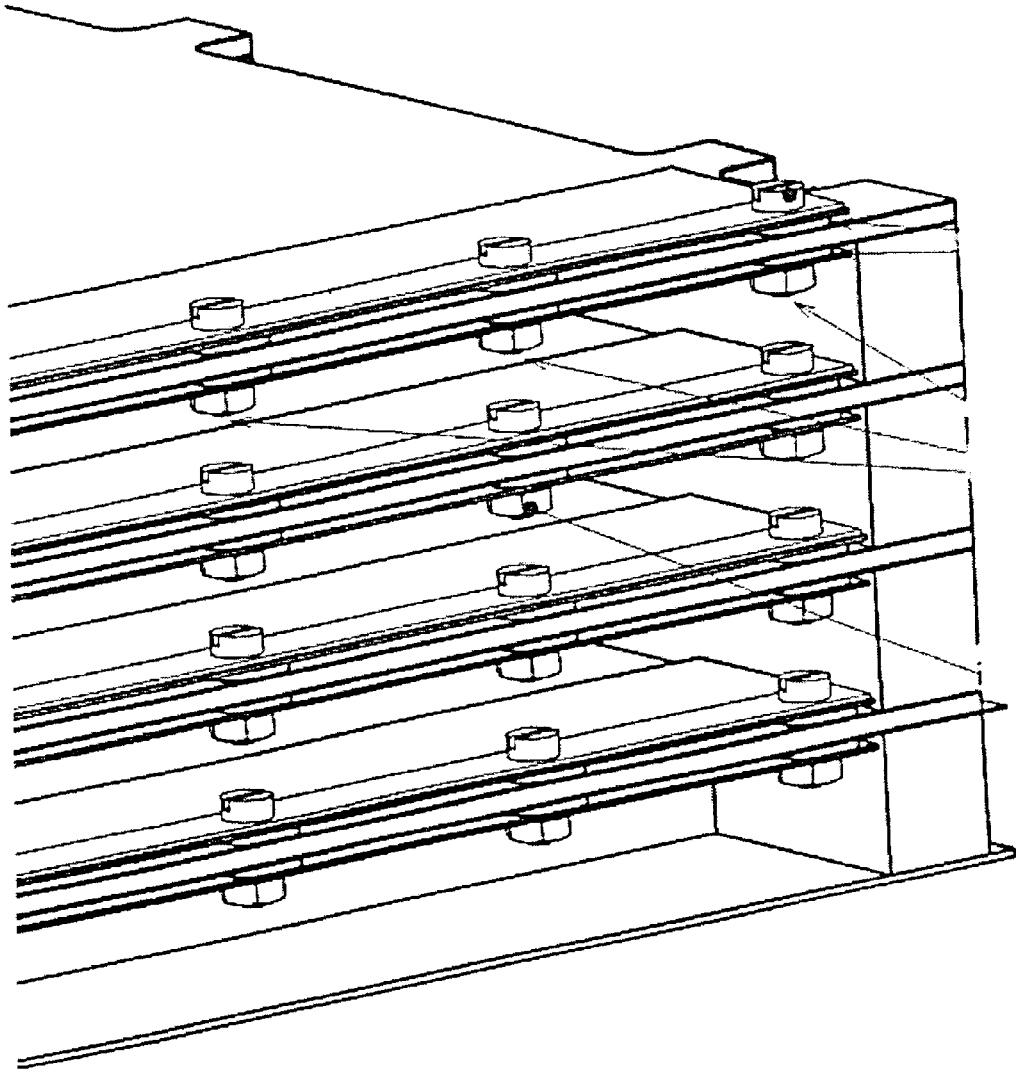
FIG. 3 is a perspective view showing the arrangement of the condensing heat exchanger according to a first embodiment of the invention.

FIG. 3 shows a perspective view of a condensing heat exchanger 16 according to a first embodiment of the invention. The air flow 10 in the air flow channel 4 and the slurper flow 9 in the slurper channel 8 are indicated. The plates 5 forming the capillary bridge are mounted in pairs on either side of each air flow channel 4 of the slurper section 3. The distance between the plates 5 and the air flow channel 5 is maintained by spacers 17. The spacers 17 and the plates 5 are attached to the surface of the air flow channel 4 by bolts 15.

Figure 4:
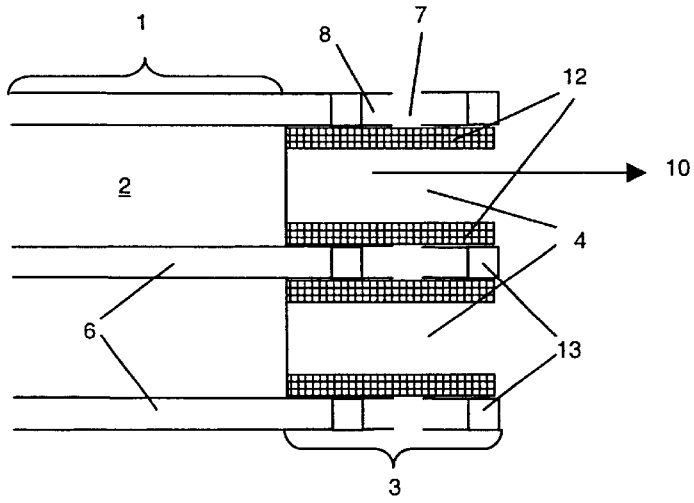
FIG. 4 is a cross sectional side view along the line X–X' of the condensing heat exchanger of FIG. 1 with the additional capillary bridge according to a second embodiment of the invention.

FIG. 4 shows a second embodiment of the capillary bridge connecting the condensing section 1 and the slurper section 3 according to the invention. The capillary bridge comprises a mesh 12 which is attached on either side of the air flow channel 4 with no spacers between the mesh 12 and the internal surface of the air flow channel 4. Further, the mesh 12 is in direct contact with the air fins 2 of the condenser section 1. Thus, the condensed water of the air flow 10 in the condenser section 1 penetrates through the mesh 12 inside the slurper section 3 and towards the slurper holes 7 where the water exits the slurper section 3 through the slurper channel 8.

Figure 5:
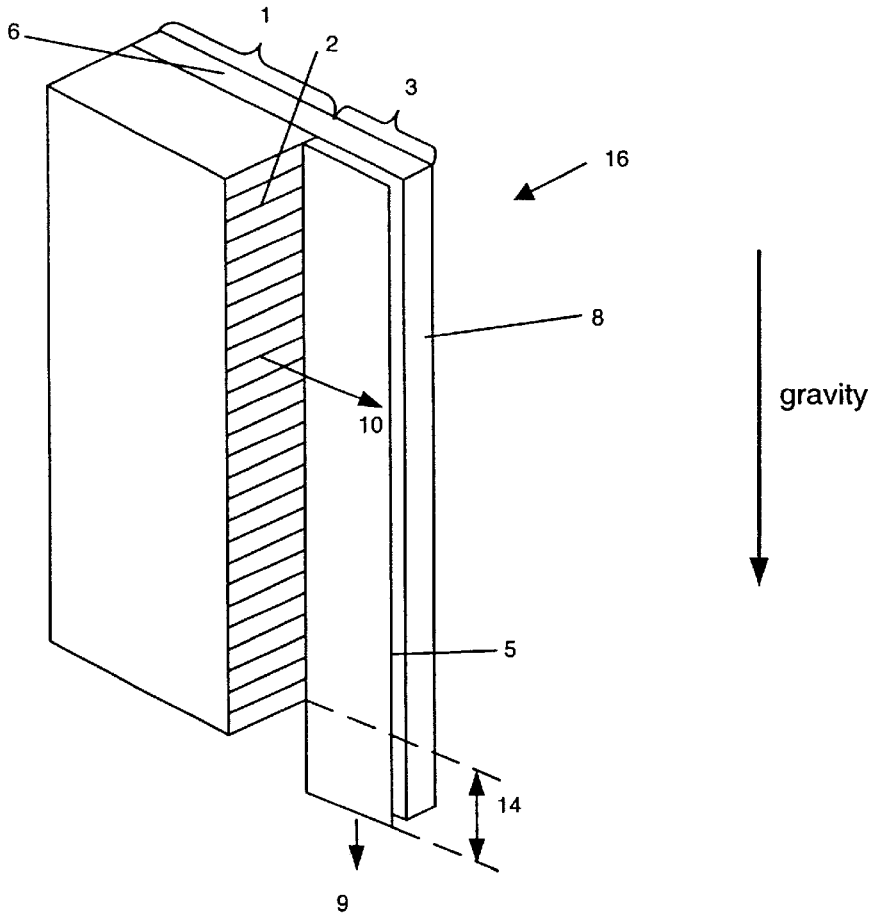
FIG. 5 is a perspective view of a further embodiment of the condensing heat exchanger especially for use under 1 gravity conditions.

FIG. 5 shows another embodiment of the condensing heat exchanger according to the invention suitable for use especially under 1 gravity conditions. The condensing heat exchanger 16 comprising the condenser section 1 and the slurper section 3 including the capillary bridge is oriented such that the plate 5 of the capillary bridge is oriented parallel to the gravity force. The water sucked into the capillary bridge by capillary forces is pulled down to the bottom of the capillary bridge by gravity. At the bottom of the capillary bridge a water column is formed. If the height of the water column in the capillary bridge produces a hydrostatic pressure which is greater than the capillary pressure of the capillary bridge the water can leave the capillary bridge.

In order not to block the water suction from the fins located at the bottom of the condenser section 1 the slurper section including the capillary bridge has to be extended below the bottom of the condensing heat exchanger. The minimum length of the extension 14 is the height of a water column required to establish a hydrostatic pressure greater than the capillary pressure of the capillary bridge, Thus, the length of the extension 14 varies with the distance between the surface of the air flow channel 4 and the plate 5.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A condensing heat exchanger comprising:

a condenser section comprising a plurality of internal fins, on which water is condensed during operation, a succeeding slurper section in which condensate is removed, wherein the condenser section and the slurper section are connected by a capillary bridge, the capillary bridge comprising one or more capillary spaces wherein the condensate formed on the fins during operation is transported inside the slurper section by capillary forces.

2. The heat exchanger of claim 1, wherein the capillary bridge comprises at least one plate arranged in proximity to a section of an internal surface of the slurper section, interstitial spaces defining the capillary space for transportation of the condensate.

3. The heat exchanger of claim 1, wherein the plate is attachable by one selected from the group consisting of bolts and clamps.

4. The heat exchanger of claim 1, wherein the capillary bridge comprises one selected from the group consisting of mesh and fleece.

5. The heat exchanger of claim 1, wherein the surface of the condenser section is coated.

6. The heat exchanger of claim 1, wherein reduced pressure is used to remove condensate in the slurper section.

7. The heat exchanger of claim 1, wherein gravitational force is used to remove condensate in the slurper section.

8. The heat exchanger of claim 2, wherein the heat exchanger is arranged within a gravity field whereby the plates of the capillary bridge are oriented in an angle to the gravitational force such that the condensate can be removed solely by the gravitational force.

9. The heat exchanger of claim 8, wherein the slurper section including the capillary bridge extends partially below the condenser section.

10. A method of cooling air in a condensing heat exchanger, the method comprising:

condensing water from air in a condenser section of a condensing heat exchanger to form condensate on a plurality of internal fins within the heat exchanger; and transporting the condensate away from the fins by a capillary bridge within a slurper section of the heat exchanger.

* * * * *